US007938063B2

(12) United States Patent
Komuro et al.

(10) Patent No.: US 7,938,063 B2
(45) Date of Patent: May 10, 2011

(54) LIQUID SUPPLY APPARATUS

(75) Inventors: Isao Komuro, Noda (JP); Akehiro Kusaka, Noda (JP)

(73) Assignee: Komori Corporation, Tokyo (JP)

( * ) Notice: Subject to any disclaimer, the term of this patent is extended or adjusted under 35 U.S.C. 154(b) by 539 days.

(21) Appl. No.: 11/877,462

(22) Filed: Oct. 23, 2007

(65) Prior Publication Data

US 2008/0105146 A1 May 8, 2008

(30) Foreign Application Priority Data

Oct. 23, 2006 (JP) ..... 2006-287425

(51) Int. Cl.
*B41L 13/00* (2006.01)

(52) U.S. Cl. ..... 101/120; 101/116; 118/406

(58) Field of Classification Search ..... 101/114, 101/116, 119, 120, 123, 129, 150–154; 118/406
See application file for complete search history.

(56) References Cited

U.S. PATENT DOCUMENTS

| | | | | |
|---|---|---|---|---|
| 3,844,213 | A | 10/1974 | Graybeal | |
| 4,103,615 | A * | 8/1978 | Cruz et al. | 101/120 |
| 4,436,032 | A * | 3/1984 | van Ouwerkerk | 101/120 |
| 5,375,516 | A * | 12/1994 | Hasegawa | 101/116 |
| 6,155,165 | A * | 12/2000 | Kaule | 101/116 |
| 6,202,554 | B1 * | 3/2001 | Kamoda | 101/153 |
| 6,681,690 | B2 * | 1/2004 | Schaede | 101/120 |
| 2006/0283343 | A1 * | 12/2006 | Koyama et al. | 101/119 |

FOREIGN PATENT DOCUMENTS

| | | |
|---|---|---|
| DE | 1760331 | 12/1971 |
| EP | 1602 483 A1 | 12/2005 |
| JP | 11-188852 A | 7/1999 |
| JP | 2000-127351 A | 5/2000 |
| WO | WO 97/34767 A1 | 9/1997 |

* cited by examiner

*Primary Examiner* — Ren Yan
(74) *Attorney, Agent, or Firm* — Birch, Stewart, Kolasch & Birch, LLP

(57) ABSTRACT

An intaglio printing press includes, a rotary screen comprising a hollow cylinder, which has a small hole group for special ink supply formed in a circumferential surface of the hollow cylinder and which is supported rotatably, and a squeegee contacting an inner peripheral surface of the hollow cylinder, a rubber roller supported rotatably to oppose an outer peripheral surface of the hollow cylinder at a position where the squeegee contacts the inner peripheral surface of the hollow cylinder, and a sheet supplied with special ink, which has been stored within the hollow cylinder, by the squeegee via the small hole group of the hollow cylinder. The intaglio printing press further includes special ink guide means, such as guide grooves, for guiding a surplus of the special ink, which is not supplied to the sheet by the squeegee, to the small hole group of the hollow cylinder.

8 Claims, 9 Drawing Sheets

LIQUID SUPPLY APPARATUS

BACKGROUND OF THE INVENTION

1. Field of the Invention

This invention relates to a liquid supply apparatus preferred when used in a printing press, which can perform rotary screen printing or coating, or in a coating machine.

2. Description of the Related Art

Among existing printing presses capable of rotary screen printing are those disclosed, for example, in Japanese Unexamined Patent Publication No. 1999-188852 (hereinafter referred to as Patent Document 1) and Japanese Unexamined Patent Publication No. 2000-127351 (hereinafter referred to as Patent Document 2).

The printing press disclosed in Patent Document 1 includes an impression cylinder, an intaglio cylinder in contact with the impression cylinder, a blanket cylinder in contact with the intaglio cylinder, a plurality of pattern rollers in contact with the blanket cylinder, a plurality of first ink supply means for supplying inks to the pattern rollers, and a second ink supply means for supplying ink to the blanket cylinder with the use of a rotary screen. In Examples of Patent Document 1, the rotary screen contacts the blanket cylinder via a rubber roller.

The printing press disclosed in Patent Document 2 is an intaglio printing press including a plate cylinder having an intaglio mounted on a circumferential surface thereof, an impression cylinder in contact with the plate cylinder, an ink collecting cylinder in contact with the plate cylinder and having a blanket mounted on a circumferential surface thereof, a first ink supply means for supplying ink to the blanket of the ink collecting cylinder, a second ink supply means in contact with the plate cylinder for supplying ink to the intaglio, and a wiping roller in contact with the plate cylinder, the second ink supply means being furnished with a rotary screen. In Examples of Patent Document 2, the rotary screen contacts the plate cylinder via a rubber roller.

In the printing presses disclosed in Patent Document 1 and Patent Document 2, however, rotary screen printing is carried out, with the rotary screen being located below the rubber roller to feed ink upwardly of the screen. Thus, it cannot be expected for ink, which has been scraped off by a squeegee, to fall reliably onto a pattern forming portion (a small hole group) of the screen. This has posed the problem that an adequate amount of ink fails to be supplied to the pattern forming portion, thereby causing nonuniformity in printing, and inducing an increased waste of paper.

The present invention has been accomplished in light of the above-described problem. The invention provides a liquid supply apparatus which can continuously supply an adequate amount of liquid to the small hole group in the plate material.

SUMMARY OF THE INVENTION

An aspect of the present invention is a liquid supply apparatus including a plate cylinder comprising a plate material, which has a small hole group for liquid supply formed in a circumferential surface of the plate material and which is supported rotatably, and a squeegee contacting an inner peripheral surface of the plate material, a rotating body supported rotatably to oppose an outer peripheral surface of the plate material at a position where the squeegee contacts the inner peripheral surface of the plate material, and a material to be supplied with a liquid, the material being supplied with the liquid, which has been stored within the plate material, by the squeegee via the small hole group of the plate material, the liquid supply apparatus comprising liquid guide means for guiding a surplus of the liquid, which is not supplied to the small hole group of the plate material by the squeegee, to the small hole group of the plate material.

The liquid guide means may collect the liquid, which does not correspond to the small hole group, and guide the collected liquid to a position corresponding to the small hole group.

Preferably, the liquid guide means does not guide the liquid to a position which does not correspond to the small hole group.

The plate material may have a plurality of the small hole groups with predetermined spacing provided in a cylinder axis direction of the plate cylinder, and the liquid guide means may have a plurality of guide portions, the guide portions facing and corresponding to the small hole groups.

The liquid guide means may be a plurality of guide grooves disposed at spaced locations in a cylinder axis direction of the plate cylinder.

The liquid guide means may be guide passages formed between a plurality of weirs disposed at spaced locations in a cylinder axis direction of the plate cylinder.

The liquid guide means may have a liquid reservoir for recovering the liquid flowing downward on the squeegee, and a liquid discharge hole bored in the liquid reservoir.

The liquid guide means may have a liquid reservoir for recovering the liquid flowing downward on the squeegee, a storage tank into which the liquid accumulated in the liquid reservoir is discharged, and a liquid supply hole for supplying the liquid stored in the storage tank to the small hole group.

The liquid reservoir may be a recovery pan provided below the squeegee.

The liquid reservoir may be integrally formed in a fixing member for the squeegee.

The liquid reservoir may be formed on a holding plate for the squeegee.

The liquid reservoir and the storage tank may be connected by piping, and the liquid supply hole and the storage tank may be connected by piping.

The liquid supply apparatus may further comprise a pump for supplying the liquid within the storage tank to the small hole group through the liquid supply hole.

The liquid may be dropped by the liquid guide means onto a site of the plate material which is upstream, in a rotating direction of the plate material, of the position where the squeegee contacts the inner peripheral surface of the plate material.

The squeegee may contact the inner peripheral surface of an upper portion of the plate material.

The plate cylinder may be provided below the rotating body.

The liquid supply apparatus may further comprise a sensor for detecting the surplus of the liquid, which is not supplied to the small hole group of the plate material by the squeegee, and liquid supply means for supplying the liquid to the inner peripheral surface of the plate material, and the liquid supply means may be controlled in response to an output of the sensor upon detection.

The guide grooves may be formed in a squeegee holding plate for supporting the squeegee on a fixing member.

According to the liquid supply apparatus having the above features, the surplus liquid can be supplied to the small hole group of the plate material by the liquid guide means reliably in a sufficient amount. Hence, the occurrence of nonuniformity in printing, for example, can be avoided to prevent an increase in a waste of paper.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

A liquid supply apparatus according to the present invention will be described in detail by embodiments with reference to the accompanying drawings.

Embodiment 1

Figure 1A:
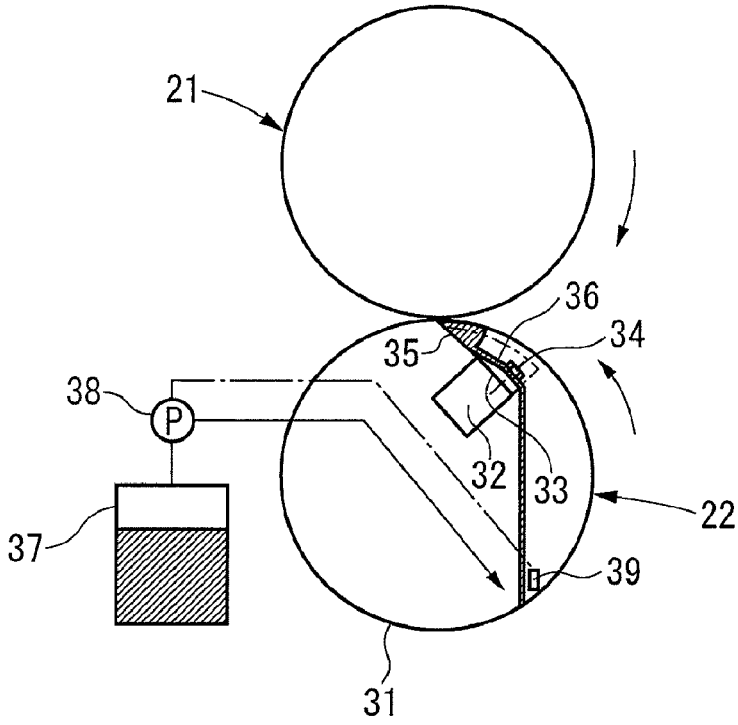
FIG. 1A is an enlarged view of a rotary screen printing unit showing Embodiment 1 of the present invention.
Figure 1B:
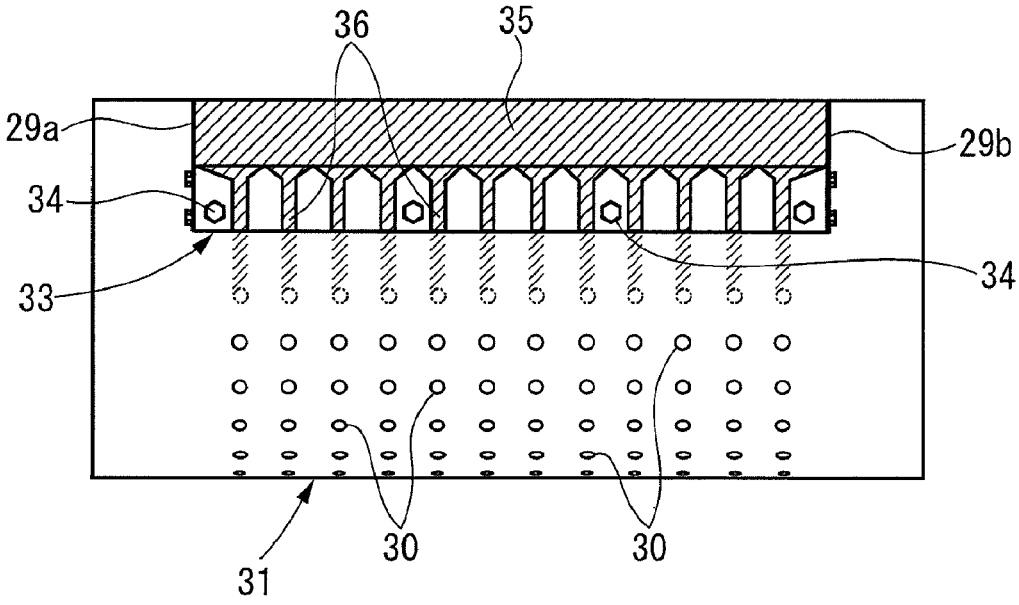
FIG. 1B is a configuration drawing of the interior of a rotary screen.
Figure 2:
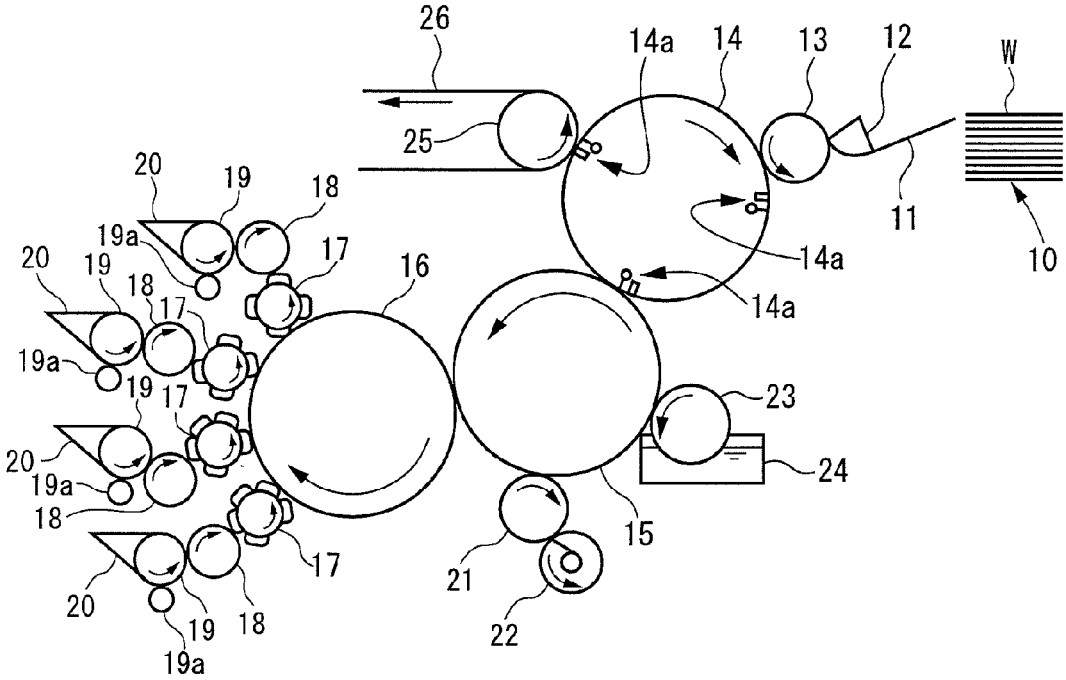
FIG. 2 is a schematic configuration drawing of an intaglio printing press.

FIG. 1A is an enlarged view of a rotary screen printing unit showing Embodiment 1 of the present invention. FIG. 1B is a configuration drawing of the interior of a rotary screen. FIG. 2 is a schematic configuration drawing of an intaglio printing press.

As shown in FIG. 2, a sheet feeder 10 bearing sheets (materials to be supplied with a liquid) w communicates with a feedboard 11 which receives the sheets W fed, one by one, from the top of a sheet pile by a sucker mechanism of the sheet feeder 10. A swing arm shaft pregripper 12, which grips the sheet W on the feedboard 11 and swings, is disposed on the feedboard 11.

The swing arm shaft pregripper 12 communicates with an impression cylinder 14 via a transfer cylinder 13, the impression cylinder 14 having a plurality of (three in the illustrated embodiment) grippers (gripper devices) 14*a* disposed thereon with equal spacing in the circumferential direction. The transfer cylinder 13 is provided with grippers (gripper devices) similar to those of the impression cylinder 14. Thus, the sheet W transferred from the swing arm shaft pregripper 12 to the grippers of the transfer cylinder 13 can be passed on to the grippers of the impression cylinder 14.

The impression cylinder 14 is in contact with a plate cylinder 15 which can be mounted with a plurality of intaglios along the circumferential direction of the plate cylinder 15. The intaglio of the plate cylinder 15 is in contact with an ink collecting cylinder 16 which can be mounted with a plurality of rubber blankets along the circumferential direction of the ink collecting cylinder 16. The ink collecting cylinder 16 is in contact with a plurality of (four in the illustrated embodiment) chablon rollers 17 arranged in the circumferential direction of the ink collecting cylinder 16. These chablon rollers 17 are each in contact with an ink fountain 20 via an ink fountain roller 19 and an intermediate roller 18, the ink fountain 20 being filled with conventional ink for printing a main design.

The plate cylinder 15 is in contact with a rotary screen (stencil printing plate cylinder) 22 via a rubber roller (rotating body) 21, the rotary screen 22 being filled interiorly with special ink (liquid) such as OVI (optical variable ink) for printing a design for counterfeit deterrence.

As shown in FIGS. 1A and 1B, the rotary screen 22 comprises a hollow cylinder 31 which is a thin screen (a plate material made of stainless steel, nickel or the like) formed in a cylindrical shape and etched with a small hole group 30 corresponding to a pattern. A squeegee (may be called a blade) 35 fastened onto a fixing bar (fixing member) 32, which is supported by frames (not shown), by bolts 34 via a squeegee holding plate 33 is positioned within the hollow cylinder 31. The hollow cylinder 31 is rotatably supported by the frames. In FIG. 1B, the small hole group 30 is illustrated as one circle. Thus, the small hole groups 30 are formed at many locations in correspondence with pattern forming portions of the hollow cylinder 31.

With the hollow cylinder 31 being rotated, special ink (indicated by a hatching in FIG. 1A and FIG. 1B) supplied into the hollow cylinder 31 by the squeegee 35 is dispatched through the small hole groups 30 of the hollow cylinder 31, whereby the special ink can be supplied to the intaglio of the plate cylinder 15 via a printing pattern (a liquid accepting surface) of a blanket (not shown) of the rubber roller 21. That is, the rotary screen 22 can directly feed the special ink in a predetermined pattern, by a constant amount at each feeding.

In the present embodiment, moreover, a surplus of special ink, which occurs between the squeegee 35 and a site of the hollow cylinder 31 upstream, in the rotating direction of the rotary screen 22, of the position where the squeegee 35 contacts the hollow cylinder 31, can be supplied by a liquid guide means (to be described later) to the small hole groups 30 of the hollow cylinder 31 formed upstream, in the rotating direction of the rotary screen 22, of the position where the rotary screen 22 opposes the rubber roller 21.

As the above-mentioned liquid guide means, a plurality of guide grooves 36 are formed in the upper surface of the squeegee holding plate 33 at predetermined intervals in the cylinder axis direction of the rotary screen 22. The positions of formation of these guide grooves 36 correspond to the positions of the small hole groups 30 in the hollow cylinder 31 in the cylinder axis direction of the rotary screen 22.

To the interior of the hollow cylinder 31, special ink stored in a storage tank 37 is supplied via a pump 38 by a necessary amount in case of necessity. In the illustrated embodiment, the pump 38 is drivingly controlled by a controller (not shown) in response to a detection signal of a liquid level sensor 39. In FIGS. 1A and 1B, reference numerals 29*a* and 29*b* denote ink guides for lateral squeegee leakage prevention which are secured to the fixing bar 32.

Because of the above configuration, the sheets W, which have been fed, one by one, from the sheet feeder 10 onto the feedboard 11, are transferred from the swing arm shaft pregripper 12 to the grippers 14*a* of the impression cylinder 14 via the transfer cylinder 13, and transported while being gripped by the grippers 14*a*. Separately, conventional inks are supplied from within the ink fountains 20 to the chablon rollers 17 via the ink fountain rollers 19 and the intermediate rollers 18, then supplied to the ink collecting cylinder 16, and then supplied in a lump to the intaglio of the plate cylinder 15. Also, special ink is directly supplied from within the rotary screen 22 to the intaglio of the plate cylinder 15 via the rubber roller 21 by the constant amount at each feeding in the predetermined pattern. These inks have their surplus amounts removed by a wiping roller 23, and are then transferred to the sheet W passed on to the impression cylinder 14 for printing. The printed sheet W is transported by a delivery chain 26 via a delivery cylinder 25 for delivery.

On this occasion, in the rotary screen 22, the surplus special ink flowing downward on the squeegee 35 is dropped and supplied to the small hole groups 30 of the hollow cylinder 31 by the guide grooves 36 reliably in a sufficient amount.

Hence, the occurrence of nonuniformity in printing due to the insufficient supply of ink to the pattern forming portion comprising the small hole group 30 of the hollow cylinder 31 is avoided to prevent an increase in a waste of paper.

In the present embodiment, the guide grooves 36 are formed in the upper surface of the squeegee holding plate 33, but the guide grooves 36 may be formed in the lower surface of the squeegee holding plate 33. Alternatively, a member provided with the guide grooves 36 may be separately formed, and annexed to the squeegee holding plate 33.

Embodiment 2

Figure 3:
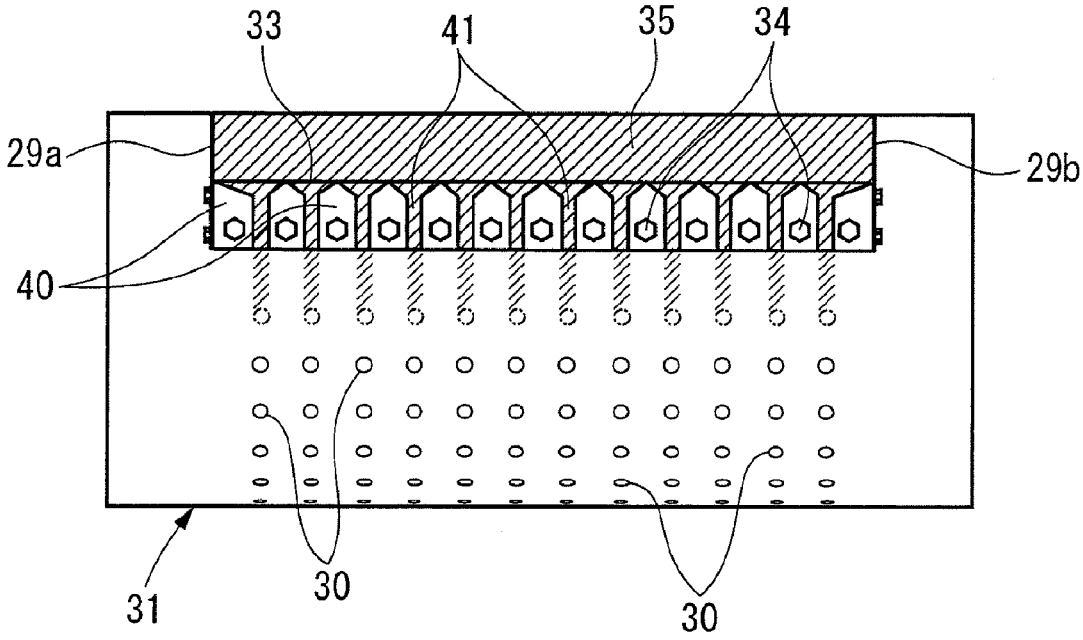
FIG. 3 is a configuration drawing of the interior of a rotary screen showing Embodiment 2 of the present invention.

FIG. 3 is a configuration drawing of the interior of a rotary screen showing Embodiment 2 of the present invention.

This is an embodiment in which instead of the guide grooves 36 in Embodiment 1, a plurality of weirs 40 are disposed on the upper surface (optionally, lower surface) of the squeegee holding plate 33 at predetermined intervals in the cylinder axis direction of the rotary screen 22 to use gaps between the adjacent weirs 40 as guide passages 41 (liquid guide means) for the special ink.

In this embodiment as well, the same actions and effects as those in Embodiment 1 are obtained.

Embodiment 3

Figure 4A:
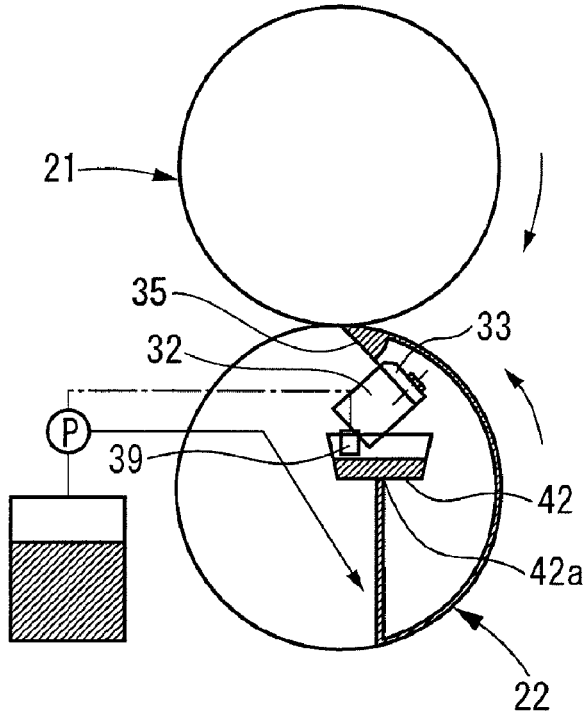
FIG. 4A is an enlarged view of a rotary screen printing unit showing Embodiment 3 of the present invention.
Figure 4B:
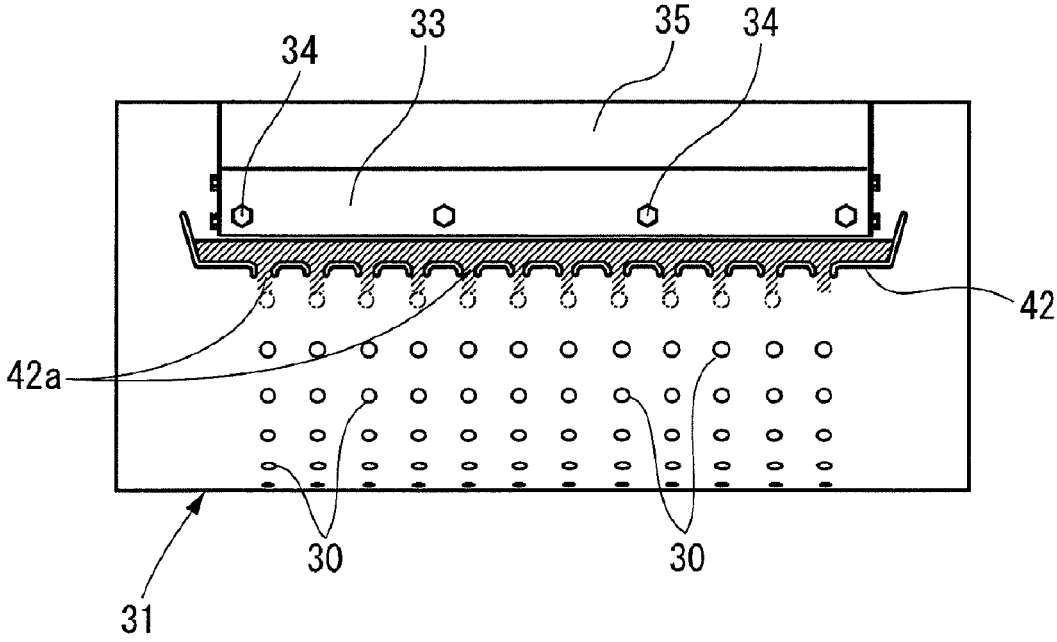
FIG. 4B is a configuration drawing of the interior of a rotary screen.

FIG. 4A is an enlarged view of a rotary screen printing unit showing Embodiment 3 of the present invention. FIG. 4B is a configuration drawing of the interior of a rotary screen.

This is an embodiment in which instead of the guide grooves 36 in Embodiment 1, a recovery pan (liquid reservoir) 42 for recovering special ink flowing downward on the squeegee 35 is provided below the squeegee 35, and a plurality of ink discharge holes (liquid discharge holes) 42*a* are bored in a bottom wall portion of the recovery pan 42 in correspondence with the small hole groups 30 of the hollow cylinder 31 so that the recovery pan 42 and the ink discharge holes 42*a* serve as a liquid guide means. In this case, a liquid level sensor 39 is provided inside the recovery pan 42.

In this embodiment as well, the same actions and effects as those in Embodiment 1 are obtained.

Embodiment 4

Figure 5A:
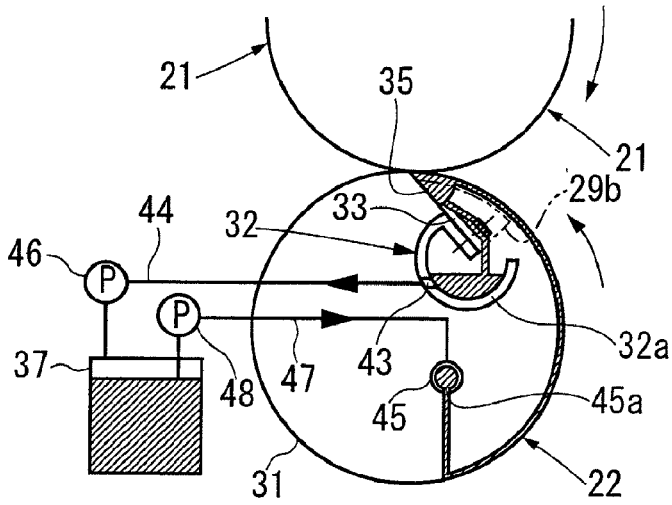
FIG. 5A is an enlarged view of a rotary screen printing unit showing Embodiment 4 of the present invention.
Figure 5B:
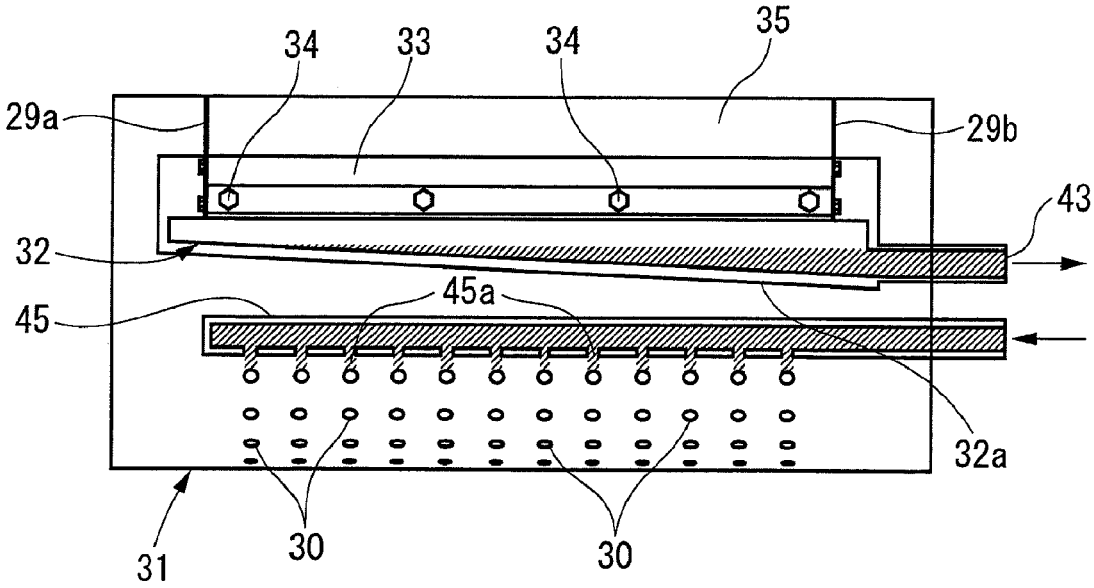
FIG. 5B is a configuration drawing of the interior of a rotary screen.

FIG. 5A is an enlarged view of a rotary screen printing unit showing Embodiment 4 of the present invention. FIG. 5B is a configuration drawing of the interior of a rotary screen.

This is an embodiment in which instead of the recovery pan 42 in Embodiment 3, a liquid reservoir 32*a* of a semicircular cross section is integrally formed in the fixing bar 32 for the squeegee 35, an ink discharge hole 43 bored in one end portion of the liquid reservoir 32*a* is connected to a storage tank 37 by piping 44, and special ink is supplied from the storage tank 37 to the small hole groups 30 of the hollow cylinder 31 via an ink supply pipe (liquid distribution and supply pipe) 45 disposed within the rotary screen 22.

In this case, a plurality of ink supply holes (liquid supply holes) 45*a* are bored in the ink supply pipe 45 in correspondence with the small hole groups 30 of the hollow cylinder 31. A bottom wall portion of the liquid reservoir 32*a* having the semicircular cross section is inclined downwardly toward the ink discharge hole 43. An ink recovery pump 46 is interposed in the piping 44 connecting the ink discharge hole 43 and the storage tank 37, and an ink supply pump 48 is interposed in piping 47 connecting the storage tank 37 and the ink supply pipe 45.

According to this embodiment, the same actions and effects as those in Embodiment 1 are obtained. In addition, special ink, which has flowed down onto the liquid reservoir 32*a* from the squeegee 35, is recovered once into the storage tank 37 without being supplied, unchanged, to the small hole groups 30 of the hollow cylinder 31. Thus, the advantage that this method is effective for printing with ink always having constant properties can be obtained. That is, if it is necessary to keep the density, viscosity, temperature, etc. of ink constant, it suffices to provide the storage tank 37 with a device suitable for attaining the desired purpose.

Embodiment 5

Figure 6A:
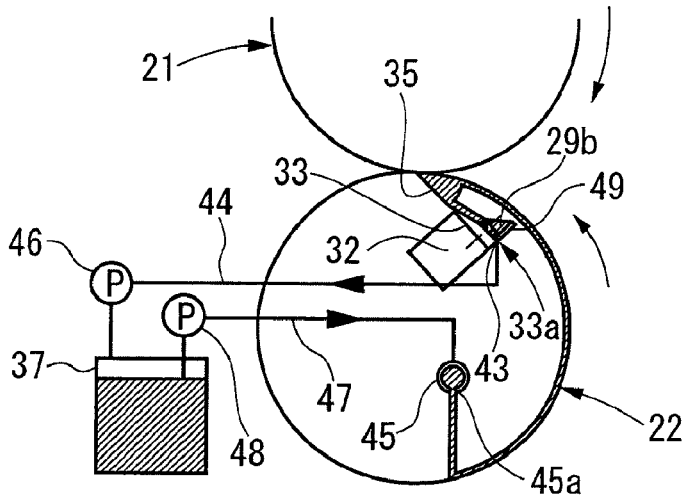
FIG. 6A is an enlarged view of a rotary screen printing unit showing Embodiment 5 of the present invention.
Figure 6B:
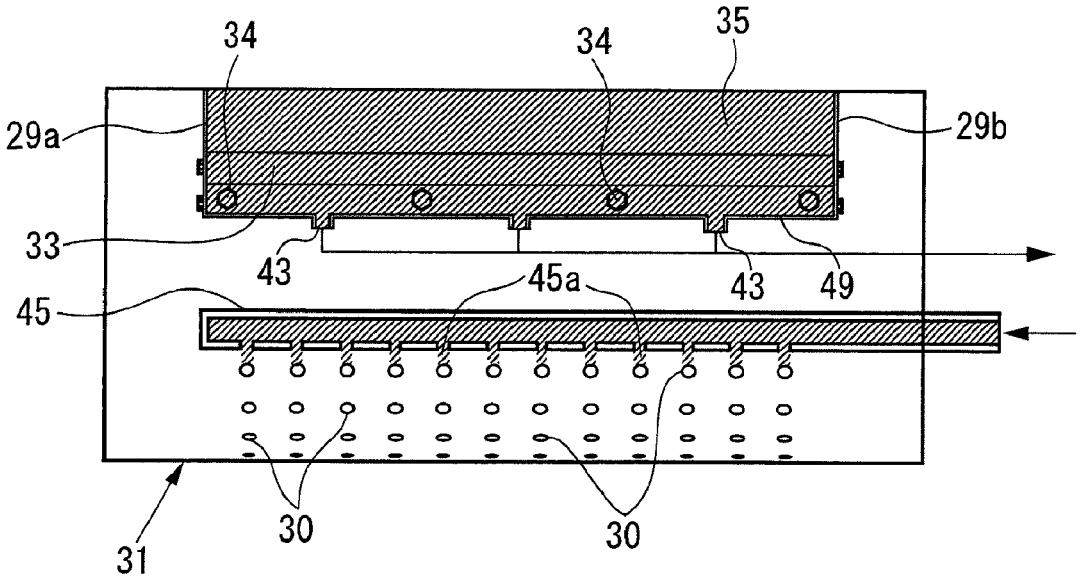
FIG. 6B is a configuration drawing of the interior of a rotary screen.

FIG. 6A is an enlarged view of a rotary screen printing unit showing Embodiment 5 of the present invention. FIG. 6B is a configuration drawing of the interior of a rotary screen.

This is an embodiment in which instead of the liquid reservoir 32*a* in Embodiment 4, a liquid reservoir 33*a* is integrally formed on the squeegee holding plate 33 from ink guides 29*a*, 29*b* and a back board 49, and other features are the same as those in Embodiment 3.

In this embodiment as well, the same actions and effects as those in Embodiment 4 are obtained.

Embodiment 6

Figure 7:
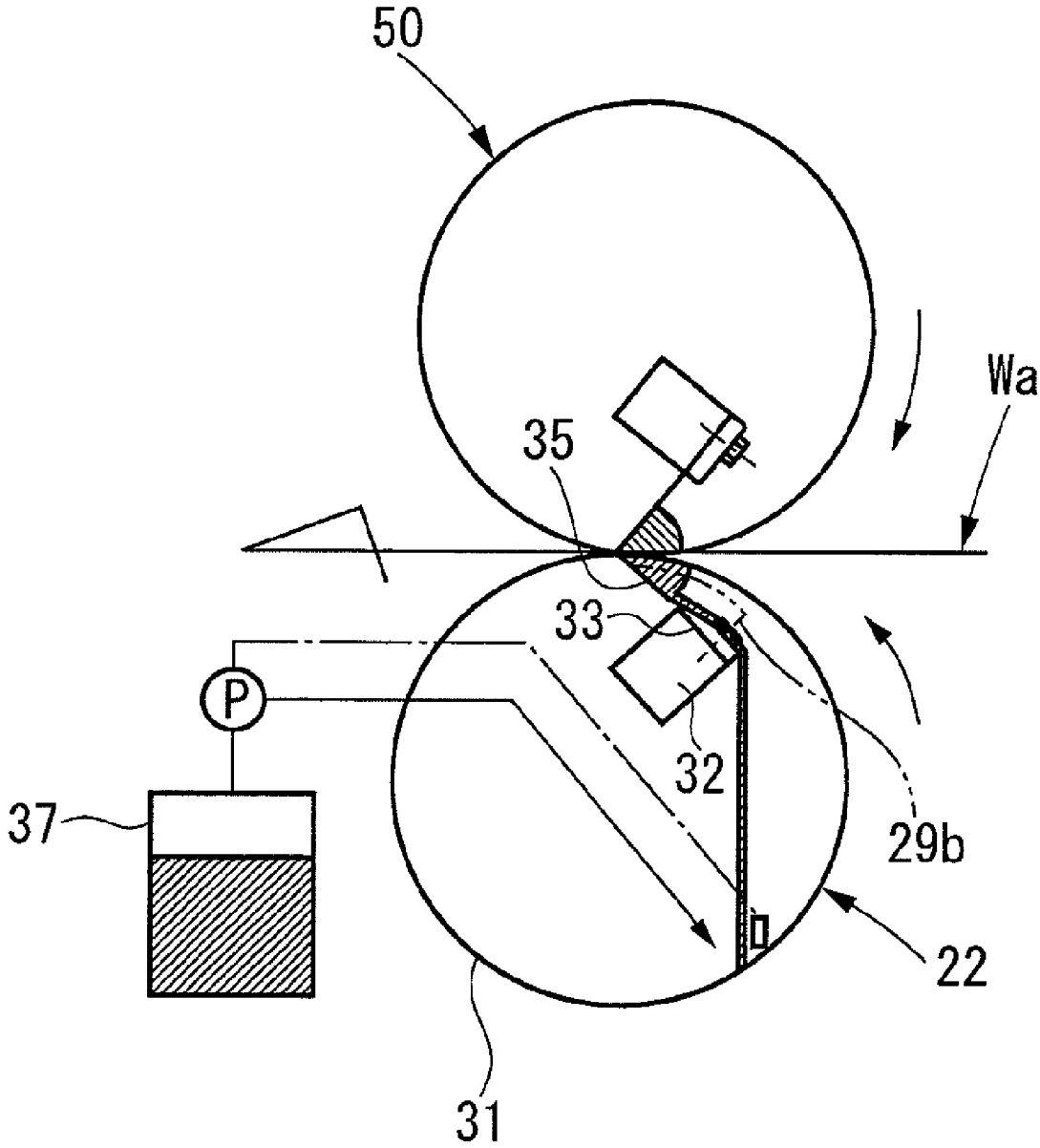
FIG. 7 is an enlarged view of a rotary screen printing unit showing Embodiment 6 of the present invention.

FIG. 7 is an enlarged view of a rotary screen printing unit showing Embodiment 6 of the present invention.

This is an embodiment in which a rotary screen 50 of a conventional structure is disposed above, and in contact with, the rotary screen 22 of Embodiment 1 (may be any of Embodiments 2 to 5) so that the present invention can be applied to a web rotary printing press in place of the sheet-fed printing press, and rotary screen printing can be applied to both surfaces of a web Wa.

In this embodiment as well, the same actions and effects as those in Embodiment 1 (Embodiments 2 to 5) are obtained in the rotary screen 22.

Embodiment 7

Figure 8:
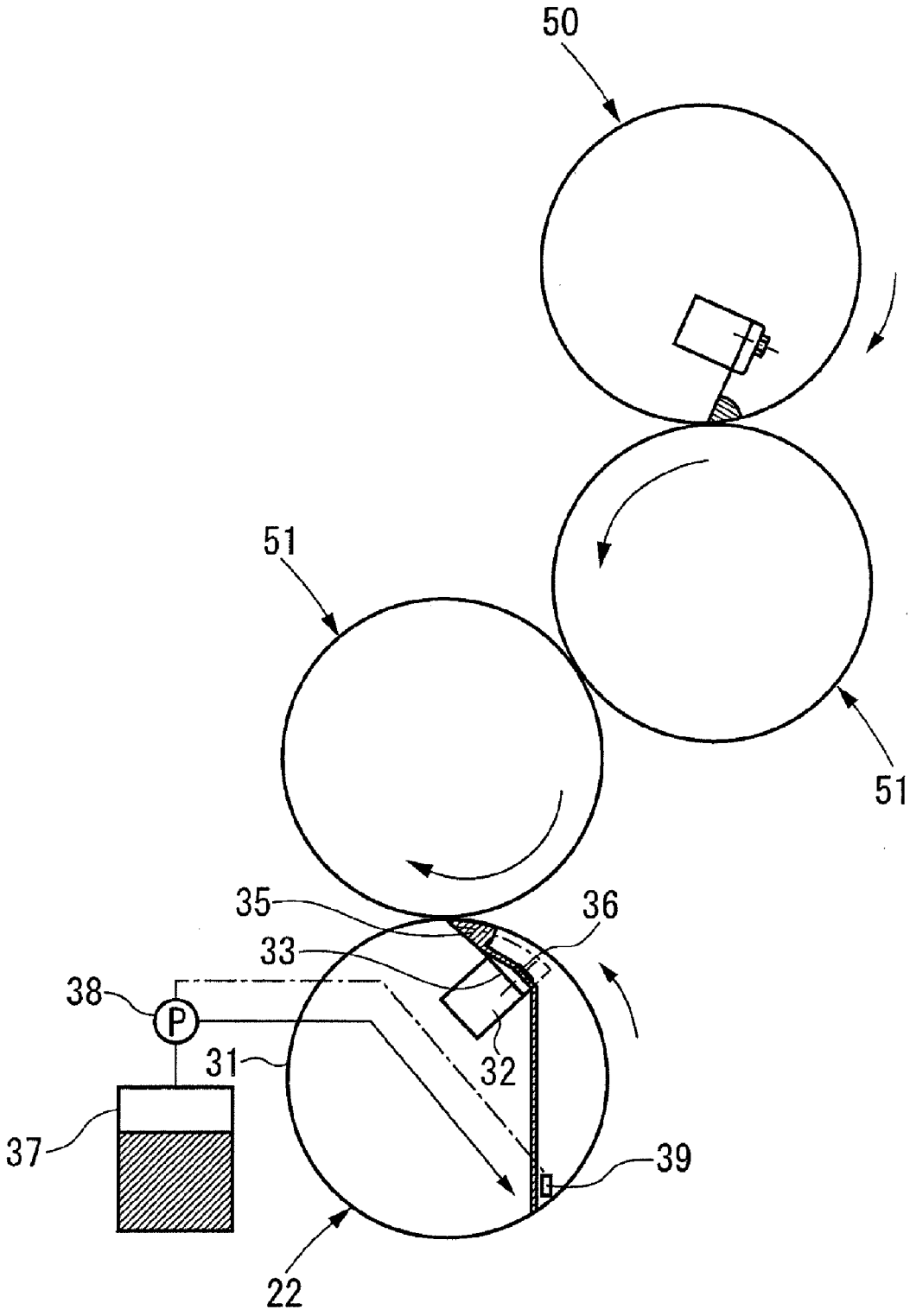
FIG. 8 is an enlarged view of a rotary screen printing unit showing Embodiment 7 of the present invention.

FIG. 8 is an enlarged view of a rotary screen printing unit showing Embodiment 7 of the present invention.

This is an embodiment in which a rotary screen 50 of a conventional structure is disposed above, and in contact with, one of adjacent impression cylinders 51, and the rotary screen 22 of Embodiment 1 (may be any of Embodiments 2 to 5) is disposed below, and in contact with, the other impression cylinder 51 so that rotary screen printing can be applied to both surfaces of a sheet W as in Embodiment 6.

In this embodiment as well, the same actions and effects as those in Embodiment 1 (Embodiments 2 to 5) are obtained in the rotary screen 22.

Embodiment 8

Figure 9:
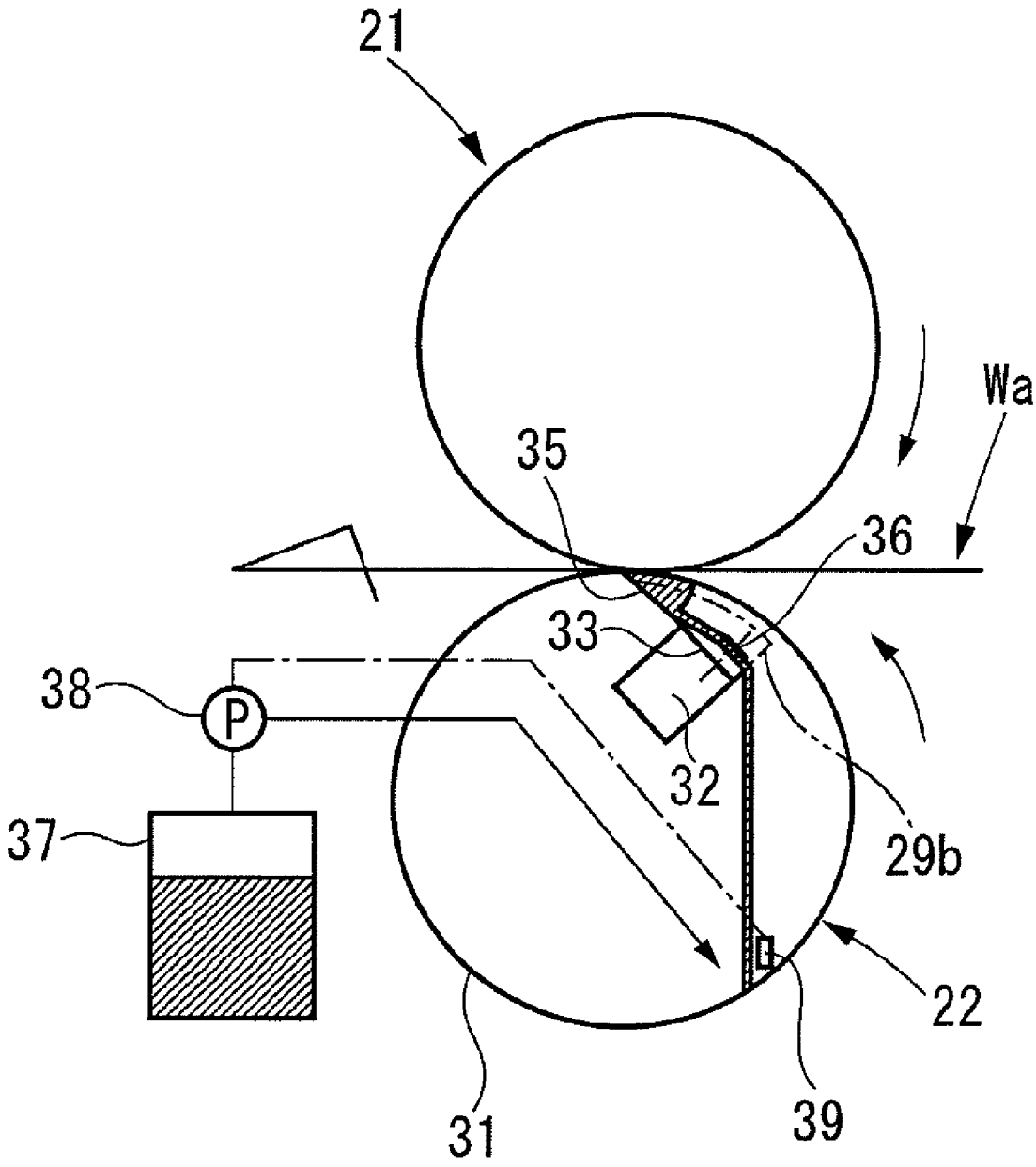
FIG. 9 is an enlarged view of a rotary screen printing unit showing Embodiment 8 of the present invention.

FIG. 9 is an enlarged view of a rotary screen printing unit showing Embodiment 8 of the present invention.

This is an embodiment in which the rotary screen printing unit of Embodiment 1 (may be any of Embodiments 2 to 7) is simply applied to a web rotary printing press in place of the sheet-fed printing press (see web Wa in FIG. 9).

In this embodiment as well, the same actions and effects as those in Embodiment 1 (Embodiments 2 to 7) are obtained in the rotary screen 22.

The invention thus described, it will be obvious that the same may be varied in many ways. For instance, examples of printing using ink as a liquid are disclosed in each of the above embodiments. However, coating may be carried out using varnish. Moreover, the present invention is not limited to the printing press, but can be applied to other liquid supply apparatuses including a stencil printing plate cylinder. Such variations are not to be regarded as a departure from the spirit and scope of the invention, and all such modifications as would be obvious to one skilled in the art are intended to be included within the scope of the following claims.

What is claimed is:

1. A liquid supply apparatus, comprising:

a plate cylinder having a plate material, which has a small hole group for liquid supply formed in a circumferential surface of the plate material and which is supported rotatably, and a squeegee contacting an inner peripheral surface of the plate material;

a rotating body supported rotatably to oppose an outer peripheral surface of the plate material at a position where the squeegee contacts the inner peripheral surface of the plate material;

a material to be supplied with a liquid, the material being supplied with the liquid, which has been stored within the plate material, by the squeegee via the small hole group of the plate material; and liquid guide means for guiding a surplus of the liquid, which is not supplied to the small hole group of the plate material by the squeegee, to the small hole group of the plate material, wherein the plate material has a plurality of the small hole groups with predetermined spacing provided in a cylinder axis direction of the plate cylinder, and the liquid guide means has a plurality of guide portions, the guide portions facing and corresponding to the small hole groups.

2. The liquid supply apparatus according to claim 1, wherein the plurality of guide portions of the liquid guide means are formed as a plurality of guide grooves disposed at spaced locations in a cylinder axis direction of the plate cylinder.

3. The liquid supply apparatus according to claim 2, wherein the guide grooves are formed in a squeegee holding plate for supporting the squeegee on a fixing member.

4. The liquid supply apparatus according to claim 1, wherein the plurality of guide portions of the liquid guide means are formed as guide passages formed between a plurality of weirs disposed at spaced locations in a cylinder axis direction of the plate cylinder.

5. The liquid supply apparatus according to claim 1, wherein the liquid is dropped by the liquid guide means onto a site of the plate material which is upstream, in a rotating direction of the plate material, of the position where the squeegee contacts the inner peripheral surface of the plate material.

6. The liquid supply apparatus according to claim 1, wherein the squeegee contacts the inner peripheral surface of an upper portion of the plate material.

7. The liquid supply apparatus according to claim 1, wherein the plate cylinder is provided below the rotating body.

8. The liquid supply apparatus according to claim 1, further comprising:

a sensor for detecting the surplus of the liquid which is not supplied to the small hole group of the plate material by the squeegee, and liquid supply means for supplying the liquid to the inner peripheral surface of the plate material, and wherein the liquid supply means is controlled in response to an output of the sensor upon detection.

* * * * *